United States Patent [19]

Nava

[11] 4,223,410

[45] Sep. 23, 1980

[54] TILTABLE VISOR FOR HELMETS, IN PARTICULAR MOTORCYCLISTS HELMETS AND SIMILAR

[76] Inventor: Pierluigi Nava, Verderio Superiore, Como, Italy

[21] Appl. No.: 955,920

[22] Filed: Oct. 30, 1978

[30] Foreign Application Priority Data

Nov. 18, 1977 [IT] Italy ..... 22775/77[U]

[51] Int. Cl.[2] ..... A42B 3/02; A61F 9/04

[52] U.S. Cl. ..... 2/424; 2/10

[58] Field of Search ..... 2/10, 9, 424, 423, 6, 2/427, 436, 437

[56] References Cited

U.S. PATENT DOCUMENTS

| | | | |
|---|---|---|---|
| 2,302,231 | 11/1942 | Lobelle | 2/10 |
| 3,423,758 | 1/1969 | Heacox | 2/424 |
| 3,797,042 | 3/1974 | Gager, Jr. | 2/10 |
| 4,100,619 | 7/1978 | Piech et al. | 2/10 |
| 4,101,980 | 7/1978 | Stepan et al. | 2/424 X |
| 4,117,553 | 10/1978 | Bay | 2/10 |

FOREIGN PATENT DOCUMENTS

| | | | |
|---|---|---|---|
| 7611248 | 4/1977 | Netherlands | 2/424 |

*Primary Examiner*—Peter P. Nerbun

*Attorney, Agent, or Firm*—Blanchard, Flynn, Thiel, Boutell & Tanis

[57] ABSTRACT

This invention concerns a tiltable shield or visor C for helmets and the like, which is hinged to the imbedded walls A2 of the helmet by means of articulated members B which, beyond permitting a swinging motion of the shield or visor, allow also a straight motion, to disengage the rim of the said shield or visor from the bottom of the peripheral ledge of the helmet A. In order to facilitate the above mentioned operation, the visor C has, next to the opposed rims thereof, curved notches 16, the curved edges 18 whereof are chamfered toward the inside, to permit and to facilitate the engagement of the fingertips of the rider, in order to separate the locking members 12, 14 which restrain the shield or visor to the helmet.

5 Claims, 2 Drawing Figures

TILTABLE VISOR FOR HELMETS, IN PARTICULAR MOTORCYCLISTS HELMETS AND SIMILAR

This invention relates to a tiltable visor for helmets, especially for motorcyclists' or similar helmets, which is adapted to increase or decrease the front opening in the helmet to meet the users' requirements.

In some known types of helmets the tiltable visor is fitted in a recess in the helmet's front part and hence does not project from it and in this case the helmet is provided with peripheral shoulders to house the visor. The visor is fitted movably by suitable hinges which enable it to perform two movements in succession: a transverse movement to shift it away from the helmet shoulders and an oscillatory movement to free the opening of the helmet, and vice versa. This type of conventional structure for mounting and moving a visor on a helmet is disclosed in French publication No. 2,338,005, made available to the public on Aug. 12, 1977 and Applicant's copending application Ser. No. 915,376.

Furthermore, the visor is secured into its lowermost position by locking devices consisting usually of flexible or spring backed buttons the two coupled elements of which are apt to hold the visor in place in the helmet shoulders.

It is evident that the above lock devices can give rise to some difficulties in tilting the visor, especially when the users' hands are, as in specific case of motorcyclists, engaged.

The invention covered by the present patent obviates these and other drawbacks in the sense that the visor contemplated is provided with apertures in the visor lock divices, said apertures acting as recesses through which the user can grasp the lateral ends of the visor and move these away from the relevant shoulders in the helmet.

In one preferred form of embodiment, the edge of the visor, adjacent to the lock devices, is provided with chamfered notches apt to facilitate engagement of the users' fingers in the unlocking phase of the lock device.

The opening or openings or notches in the flap may be shaped, if necessary, at least in part to form openings for ventilation of the helmet's interior.

The invention will now be described in conjunction with the attached drawing which illustrates, by way of example, one form of embodiment of the visor according to the invention.

Figure 1:
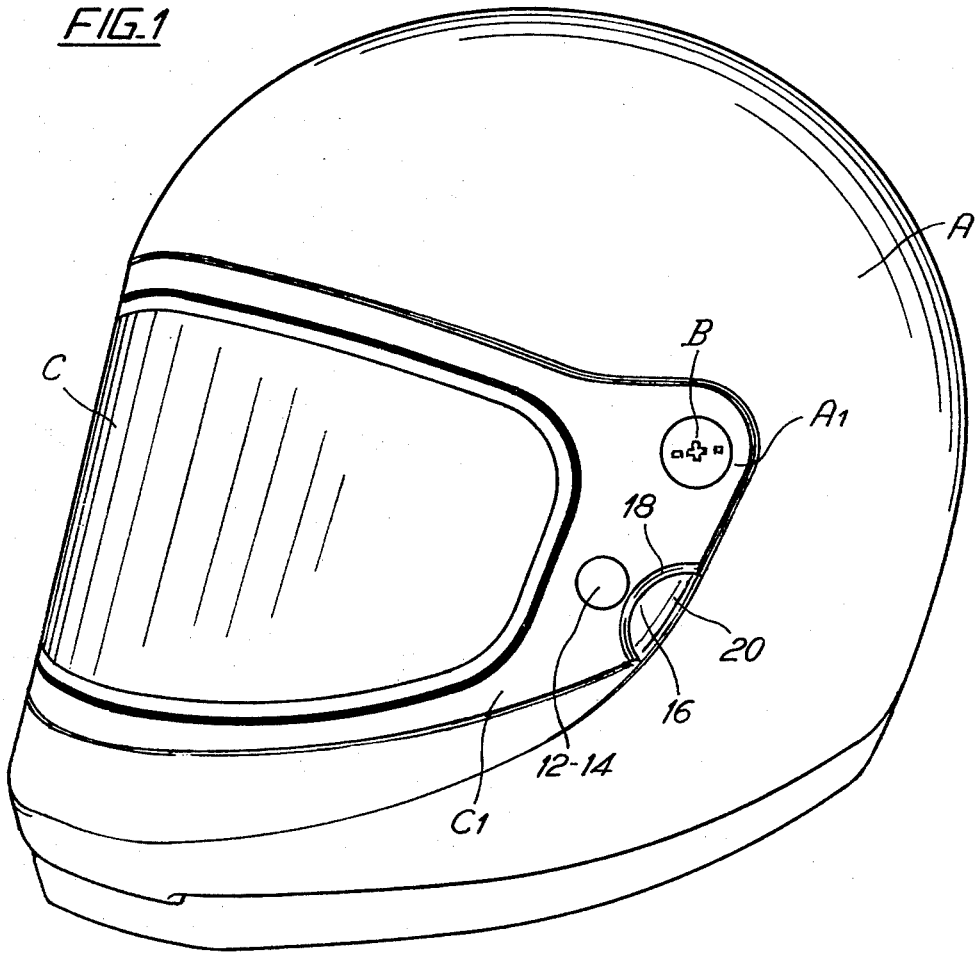
FIG. 1 is a perspective view of the helmet fitted with the visor according to the invention.
Figure 2:
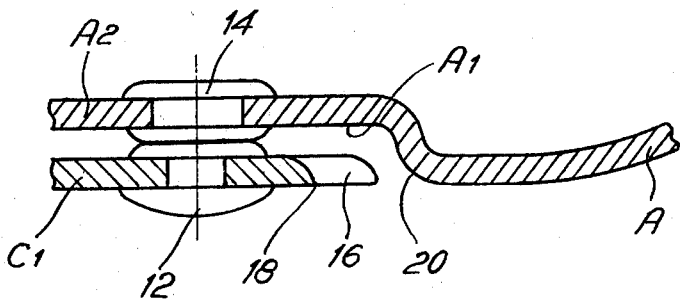
FIG. 2 is a detail (in cross-section), on a larger scale, of the visor at the position corresponding to the lock device.

With reference to these figures, it can be seen that the helmet A is provided on its front part with a peripheral shoulder A1 suitably shaped to house a visor C connected to the helmet by means B, e.g. universal joints B. Precisely, said means B are fitted between the ends, or flaps, C1 of visor C and the bottom part A2 of shoulder A1 to permit both substantially horizontal movement and oscillating movement of the visor about the axis of said universal joint connecting means B. For a showing of such conventional structure, see for example, the previously mentioned French publication No. 2,338,005.

Flaps C1 are also provided at suitable positions with lock devices 12-14, each consisting, in the known manner, of two complementary elements 12 and 14 secured respectively to wall A2 of helmet A and to said flap C1; said elements are of the fixed type and are either elastic or spring backed so as to couple with each other movably by simple elastic forcing.

According to the invention, flaps C1, at their edges and close to the lock device 12, are provided with one or more apertures or notches 16 which, in the case shown, are curved and their edge 18 is chamfered inwardly. It can thus be seen how a user can easily and quickly sepaelements 12 and 14 of lock device 12-14 to disengage flap C1 from shoulder A1 in front of the helmet and tilt visor C to the position desired.

Disengagement is simplified as the user introduces one finger, for example the thumb, into the cavity formed by notch 16 and bottom of shoulder A1 to exert a lever action, the fulcrum of which is edge 20 formed by a part of the peripheral wall of said shoulder A1.

Apertures or notches 16 may obviously be conveniently shaped as desired. In this regard, flaps C1 can be provided with a plurality of openings 16 arranged in suitable succession to form ventilating openings for the helmet interior, since a slot may be provided between flaps C1 and bottom A2 of shoulder A1 to render said openings 16 communicant with the internal part of the helmet. This slot permits making laminar the air stream entering the helmet so that the air stream will continually lap the inside transparent surface of the visor so as thus to avoid the formation of moisture or mist on said surface. Moreover, because of the position of openings 16 the entry or water or humidity into the helmet is also inhibited.

I claim:

1. A visor-helmet assembly in particular for motorcyclists and the like, comprising:

a helmet having a forward facing opening rimmed by a ledge recessed inward of the adjacent helmet wall;

a transparent visor movably supported on the helmet for closing and uncovering said opening in the helmet, said visor in its closed position having its peripheral edge housed in the outward facing recess defined by said ledge, such that the closed visor is flush with and does not protrude from the outer surface of said helmet;

means movably mounting the end portions of said visor on said helmet beside said opening for permitting movement of said visor to at least partially uncover said helmet opening;

resiliently interengageable locking means respectively fixed on said helment and said visor end portions and opposed for interengagement with said visor in its closed position, said locking means being releasable to permit said movement of said visor with respect to said helmet, said locking means retaining said visor in its closed position on said helmet, a said movable mounting means and locking means being disposed near the rear edge of the corresponding end portion of the visor; and including the improvement comprising:

a curved notch formed in the edge of said visor end portion adjacent said locking means and overlying said recessed ledge, said notch being sized for insertion of the finger of the user for permitting the user to readily pull the visor mounted portion of the locking means outward from the helmet mounted portion of the locking means, thereby unlocking said locking means, and for permitting movement of said visor guided by said mounting means for uncovering said helmet opening.

2. The apparatus of claim 1, in which said notch is chamfered along its edge overlying the recessed ledge to facilitate engagement of the user's finger for unlocking of said locking means.

3. The apparatus of claim 2, in which said visor end portion has edges flanking said notch which closely oppose the peripheral wall connecting said recessed ledge with the remaining helmet surface beyond said visor, the connection of said peripheral wall and remaining helmet surface providing an edge opposing said notch substantially in the plane of said visor, said edge providing a fulcrum against which user's finger can operate as a lever to separate the portions of said releasable connector.

4. The apparatus of claim 1, in which the end portion of said visor is spaced outboard of said recessed ledge to form a slot therebetween communicating with the interior of the helmet, said notch providing a ventilating opening communicating with said slot to permit a stream of air to enter the helmet as a laminar flow for the purpose of avoiding formation of moisture on the interior surface of the transparent visor.

5. A visor-helmet assembly in particular for motorcyclists and the like, comprising:

a helmet having a forward facing opening rimmed by a ledge recessed inward of the adjacent helmet wall;

a transparent visor movably supported on the helmet for closing and uncovering said opening in the helmet, said visor in its closed position having its peripheral edge housed in the outward facing recess defined by said ledge, such that the closed visor is flush with and does not protrude from the outer surface of said helmet;

means movably mounting the rear end portions of said visor on said helmet beside said opening for permitting movement of said visor to at least partially uncover said helmet opening;

resiliently interengageable locking means respectively fixed on said helment and said visor rear end portions and opposed for interengagement with said visor in its closed position, said locking means being releasable to permit said movement of said visor with respect to said helmet, said locking means retaining said visor in its closed position on said helmet, a said movable mounting means and locking means being disposed near the rear edge of the corresponding rear end portion of the visor; and including the improvement comprising:

a curved notch formed in the edge of said visor rear end portion adjscent said locking means and overlying said recessed ledge, said notch being sized for insertion of the finger of the user for permitting the user to readily pull the visor mounted portion of the locking means outward from the helmet mounted portion of the locking means, thereby unlocking said locking means, and for permitting movement of said visor guided by said mounting means for uncovering said helmet opening, said notch being chamfered along its edge overlying the recessed ledge to facilitate engagement of the user's finger for unlocking of said locking means, said visor rear end portion having edges flanking said notch which closely oppose the peripheral wall connecting said recessed ledge with the remaining helmet surface beyond said visor, the connection of said peripheral wall and remaining helmet surface providing an edge opposing said notch substantially in the plane of said visor, said edge providing a fulcrum against which user's finger can operate as a lever to separate the portions of said releasable connector, said locking means spacing the end portion of said visor outward from said recessed ledge to form a slot therebetween communicating with the interior of the helmet, said notch providing a ventilating opening communicating with said slot to permit a stream of air to enter the helmet as a laminar flow along the inner surface of said visor for avoiding formation of moisture on the interior surface of the transparent visor.

* * * * *